US007438205B2

(12) United States Patent
Uchikoshi

(10) Patent No.: US 7,438,205 B2
(45) Date of Patent: Oct. 21, 2008

(54) SHIRT FINISHING MACHINE

(75) Inventor: Mitsuyuki Uchikoshi, Tokyo (JP)

(73) Assignee: Sankousha Engineering Co., Ltd. (JP)

( * ) Notice: Subject to any disclaimer, the term of this patent is extended or adjusted under 35 U.S.C. 154(b) by 66 days.

(21) Appl. No.: 11/502,992

(22) Filed: Aug. 10, 2006

(65) Prior Publication Data

US 2008/0035684 A1 Feb. 14, 2008

(51) Int. Cl.
*D06C 15/00* (2006.01)

(52) U.S. Cl. ..... 223/73; 223/71; 223/52

(58) Field of Classification Search ..... 223/1, 223/52, 57, 66, 70, 73, 76; 38/7, 10, 11, 38/20, 22, 23, 138
See application file for complete search history.

(56) References Cited

U.S. PATENT DOCUMENTS 3,568,900 A * 3/1971 Paris ..... 223/70
3,613,969 A * 10/1971 Forse ..... 223/37
4,634,030 A * 1/1987 Uchikoshi ..... 223/57
5,692,326 A * 12/1997 Mohan et al. ..... 38/7
5,758,437 A * 6/1998 Tamamoto ..... 38/12
6,186,377 B1 * 2/2001 McCormick et al. ..... 223/68
6,401,992 B1 * 6/2002 Harrod et al. ..... 223/73
6,758,377 B2 7/2004 Uchikoshi
7,040,516 B2 * 5/2006 Devrick et al. ..... 223/73

* cited by examiner

*Primary Examiner*—Gary L. Welch
*Assistant Examiner*—Andrew W Sutton
(74) *Attorney, Agent, or Firm*—Andrus, Sceales, Starke & Sawall, LLP

(57) ABSTRACT

A shirt finishing machine includes a torso 2 for putting on a shirt 1 and a pair of right and left supporting arms 3. The upper part of the supporting arm 3 is provided with a lower iron 9 for setting an extremity end 1*b* of a sleeve 1*a*, a fixing instrument 14 for fixing a cuff 1*d* of the sleeve 1*a* to the lower iron 9, and an upper iron 10 for pressing against an upper surface of the lower iron 9 and for press finishing the extremity end 1*b* of the sleeve 1*a*. A movable iron 9*a* presses a lower surface of the extremity end 1*b* of the sleeve 1*a* inserted into the lower iron 10 at the time of pressing with the upper iron 10.

8 Claims, 8 Drawing Sheets

SHIRT FINISHING MACHINE

BACKGROUND OF INVENTION

1. Field of Invention

This invention relates to a shirt finishing machine for use in press finishing a shirt such as a washed white shirt and the like, and more particularly a shirt finishing machine formed to enable wrinkles to be eliminated under a state in which the shirt is put on a torso.

2. Description of Related Art

As this type of prior art shirt finishing machine, there has been provided the machine described in the gazette of U.S. Pat. No. 6,758,377, for example. This type of prior art shirt finishing machine comprises a torso for putting on a shirt, a pair of right and left supporting arms arranged at both sides of the torso and inclined toward the sides of the torso to pull the sleeves of the shirt. Then, the upper portions of the supporting arms are provided with a lower iron to which the extremity end of the sleeve is set, clamp devices for use in fixing the cuffs of the sleeves to the lower iron and an upper iron for use in pressing against the upper surface of the lower iron to press finish the extremity ends of the sleeves.

Thus, in this type of finishing machine, the extremity ends of the sleeves are inserted into the lower iron and set in their flat state. Then, the upper iron presses against the upper surface of the lower iron to press finish the upper surfaces of the extremity ends of the sleeves and concurrently the supporting arms incline to pull the sleeves, both steam and hot air are supplied from the center of the torso into the sleeves to expand the sleeves and finish them in tension. That is, this type of prior art finishing machine had a structure operated such that the sleeves are pulled while the lower surfaces of the extremity ends of the sleeves striking against the lower side of the lower iron are not pressed.

Accordingly, this type of prior art finishing machine had a problem that the lower surfaces of the extremity ends of the sleeves are pulled apart, some wrinkles are generated at these locations and the sleeves cannot be finished clean.

This invention has been invented in reference to the prior art problems.

Accordingly, a technical problem to be resolved by this invention is to provide a shirt finishing machine formed to enable the lower surfaces of the extremity ends of the sleeves to be pressed, to prevent some pulled wrinkles from being generated at the cloth at this location under a sleeve pulling operation or a sleeve expansion act and to finish the shirt clean.

SUMMARY OF INVENTION

As illustrated in FIG. 1 and the like, the present invention is formed to be provided with movable irons for use in pressing against the lower surfaces of the extremity ends of the sleeves inserted into the lower iron when the upper iron is pressed.

Accordingly, in accordance with the present invention, since the sleeves can be pulled under a state in which the lower surfaces of the extremity ends of the sleeves are being pressed with the movable irons and the shirt can be finished in tension by hot air and the like, it is possible to prevent some wrinkles from being applied to the lower surfaces of the extremity ends of the sleeves and finish the sleeves clean.

In the present invention, it is preferable that the movable irons are formed in such a way that steam and the like can be supplied into the sleeves to enable the wrinkles at the extremity ends of the sleeves to be removed neatly and the sleeves to be heated similar to the upper iron. Although the finishing machine of the present invention is normally provided with a pair of press irons at the front and rear positions of the torso, it may also be applicable that this type of press iron is eliminated.

Thus, it is preferable that the present invention is made such that a width of the lower iron in its forward and rearward direction is formed narrow as seen from above and the movable iron is arranged at the rear side of the lower iron when the upper iron performs a press action and the portion where the extremity ends of the sleeves are expelled out at the rear side of the lower iron is supported by the movable irons.

Because, in accordance with the present invention, fine formation of the lower iron facilitates insertion of the extremity ends of the sleeves into the lower iron and enables the lower surfaces of the extremity ends of the sleeves to be pressed.

In addition, it is preferable that the present invention is constructed such that the cuff portions fixed to the lower iron with fixing instruments are expelled at the front side as seen from above and there is provided a tension member for tensioning the extremity ends of the sleeves forward.

Because this arrangement enables a looseness at the extremity ends of the sleeves to be removed and a finished state of the extremity ends of the sleeves to be improved.

Additionally, as shown in FIG. 3, it is preferable that the present invention is constructed such that the movable irons are turned between the rear side of the lower iron and lower rear position of the lower iron and arranged in such a way that they can be raised or lowered.

Because, in accordance with the present invention, motion and arrangement of the movable irons can be attained rapidly and efficiently within a small space.

In this case, as shown in FIG. 6, it is preferable in the present invention that the upper iron supporting member and the movable irons are connected through a link for ascending the movable irons when the upper iron is turned forward and descends to be arranged at the rear side of the lower iron and when the upper iron is turned rearward, the movable irons are lowered and retracted to the lower and rear position of the lower iron.

Because in accordance with the present invention, the movable irons can be moved under utilization of ascending or descending action of the upper irons, an exclusive driving means only for the movable irons can be eliminated, and a less-expensive, light-weight and small-sized product of the present invention can be attained.

In addition, as shown in FIGS. 5 and 10, it is preferable in the present invention that the lower irons, fixing instruments and upper irons are fixed to the frame and arranged at the upper portions of the supporting arms, the frame is formed in such a way that it can be turned in a normal or reverse direction around an axis along a forward or rearward direction of the torso and there is provided means for adjusting a turning angle of the frame to cause the extremity ends of the lower irons to be always faced against the shoulder part of the torso as the supporting arms are turned.

Because in accordance with the present invention, it is possible to prevent the extremity end of the lower iron from pushing up the upper side of the inner surface of the sleeve or from contacting with the inner surface and to make a neat finish of the sleeve without damaging the cloth and making any wrinkles.

In addition, as shown in FIG. 4, it is preferable in the present invention that there is provided a controller for outputting a signal slightly returning the supporting arms back to the torso to a driving device for the supporting arms when the supporting arms are inclined and reach to a limited state of retraction of the shirt sleeves.

Because, in accordance with the present invention, as compared with that of a case in which the sleeves are pulled up to their limits and expanded with hot air, it is possible to prevent the cloth from being damaged. In this case, the limit of the pulled state of the sleeves is meant by a limited interface when the supporting arms are inclined more than a certain value to pull the sleeves, the cloth and the sawn location at the roots of sleeves are damaged. Whether or not the limited state of the pulled work reaches is detected and judged by a sensor for detecting a variation in gas pressure within an air cylinder when the driving device is an air cylinder, for example. Additionally, it is also applicable to judge whether or not the limited state of the pulled work reaches a certain value under setting of an extending distance of rod in advance in response to a sleeve length. In addition, a wording of "slightly" is meant by a length in which the sleeves are expanded and can be finished in tension without damaging the cloth of the sleeve and more practically, its range is several mm to several ten mm and the like. As the controller, for example, a microcomputer or a sequence can be applied.

In addition, as shown in FIG. 12, it is preferable in the present invention that both sides of the torso are provided with trunk tension members inclined toward the sides of the torso by their own weight to apply tension to the sides of the shirt covered on the torso.

When the sides of a shirt are applied with tension in this type of finishing machine in the prior art, a worker changed a tension applying distance of the trunk tension member in compliance with a size of the shirt. Due to this fact, when shirts of various sizes were intermingled, it was hard to determine a tension applying distance of the trunk tension member in compliance with a fit size and it was not avoided to generate occurrence of disturbance in a tension distance by a worker.

The present invention eliminates such problems as above. Accordingly, in accordance with the present invention, it is possible to eliminate completely the troublesome operation in which the tension applying distance of the trunk tension member must be selected in compliance with the size and it can be positively performed without being influenced by a worker's judgment. In this case, the front part of the shirt is adsorbed against the torso by applying front buttons or discharging inside the torso. This is applied to prevent the front bodice of the shirt from being worn out at a skin by the tension applying work of the trunk tension member. The trunk tension member is arranged to move up to a position where it is inclined by its own weight, through manual operation, and its returning-back operation is usually carried out automatically by an air cylinder and the like.

BRIEF DESCRIPTION OF DRAWINGS

FIG. 1 shows one preferred embodiment of the shirt finishing machine of the present invention.

DESCRIPTION OF PREFERRED EMBODIMENTS

Figure 1A:
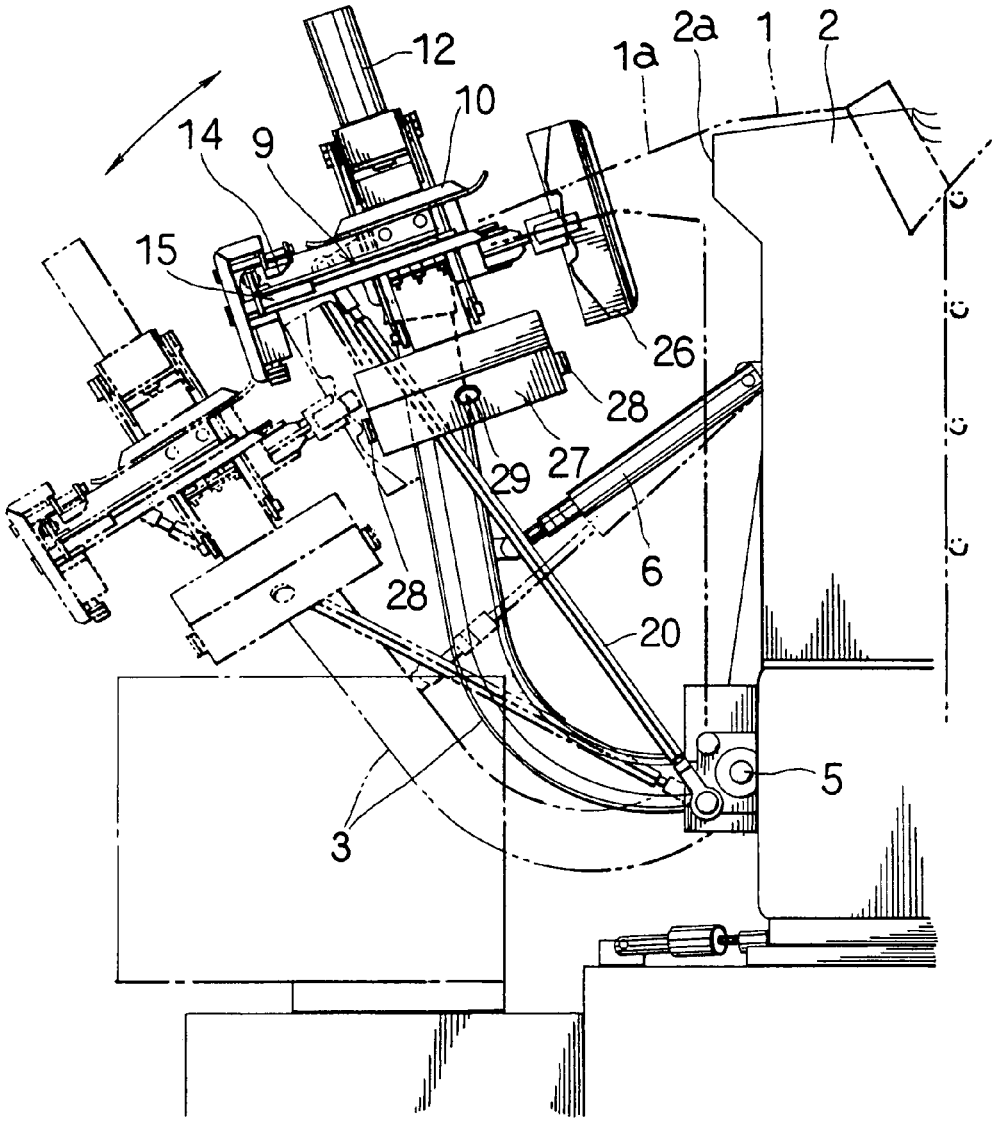
FIG. 1A is a substantial front elevational view and FIG. 1B is a substantial top plan view.

Referring now to the drawings, the preferred embodiments of the present invention will be described.

The present invention is formed to comprise a torso 2 for covering a shirt 1 such as a white shirt (a torso similar to the upper part of a human body) and a pair of right and left supporting arms 3 arranged at both sides of the torso 2, inclined to the side of the torso 2 for tensioning a sleeve 1*a* of the shirt 1. Inside part of the torso 2 is evaporated and the front bodice of the shirt 1 is formed to be adsorbed against the surface of the torso 2. In addition, the shirt finishing machine of the present invention is formed to enable both steam and hot air to be supplied from inside of the torso 2 into the sleeve 1*a* of the shirt 1 through a shoulder 2*a*.

The lower ends of the supporting arms 3 are fixed to both sides of a column 4 (refer to FIG. 11) raised at the rear side of the torso 2 through a shaft 5 extending along a forward or rearward direction of the torso 2. Reference numeral 6 denotes an air cylinder acting as a driving device for use in turning the supporting arm 3. The supporting arm 3 is raised up toward the torso 2 around the shaft 5 at its lower end or inclined to be turned by a predetermined angle from the torso 2 toward the side under an extending or retracting action of a rod in the air cylinder acting as the driving device 6. In addition, reference numeral 7 (refer to FIG. 3) denotes a pair of press irons for use in pressing both front and rear bodices of the shirt 1. The press irons 7 in this preferred embodiment are constituted to be guided by the guides 8, slid and retracted at the right side position as seen at the front elevational side of the torso 2.

Figure 1B:
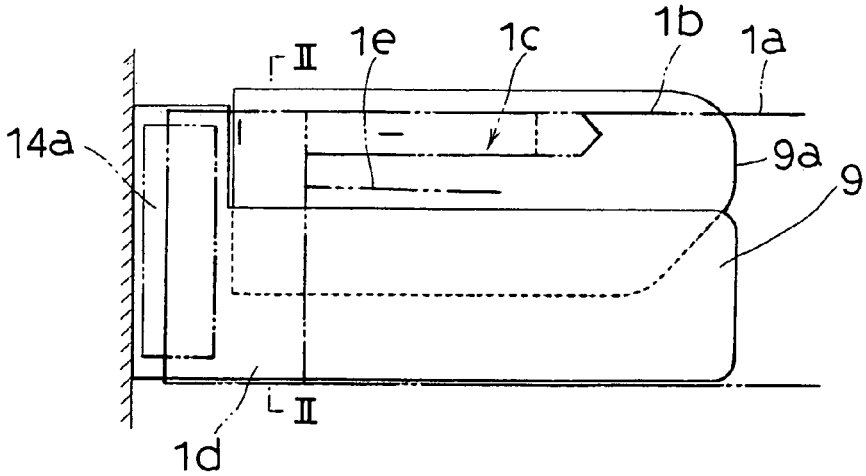
Figure 2:
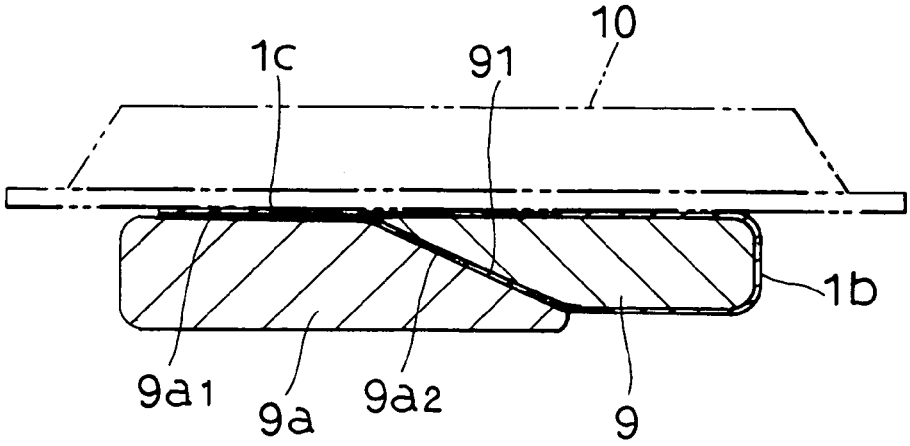
FIG. 2 is a substantial sectional view taken along line II-II of FIG. 1B.
Figure 3:
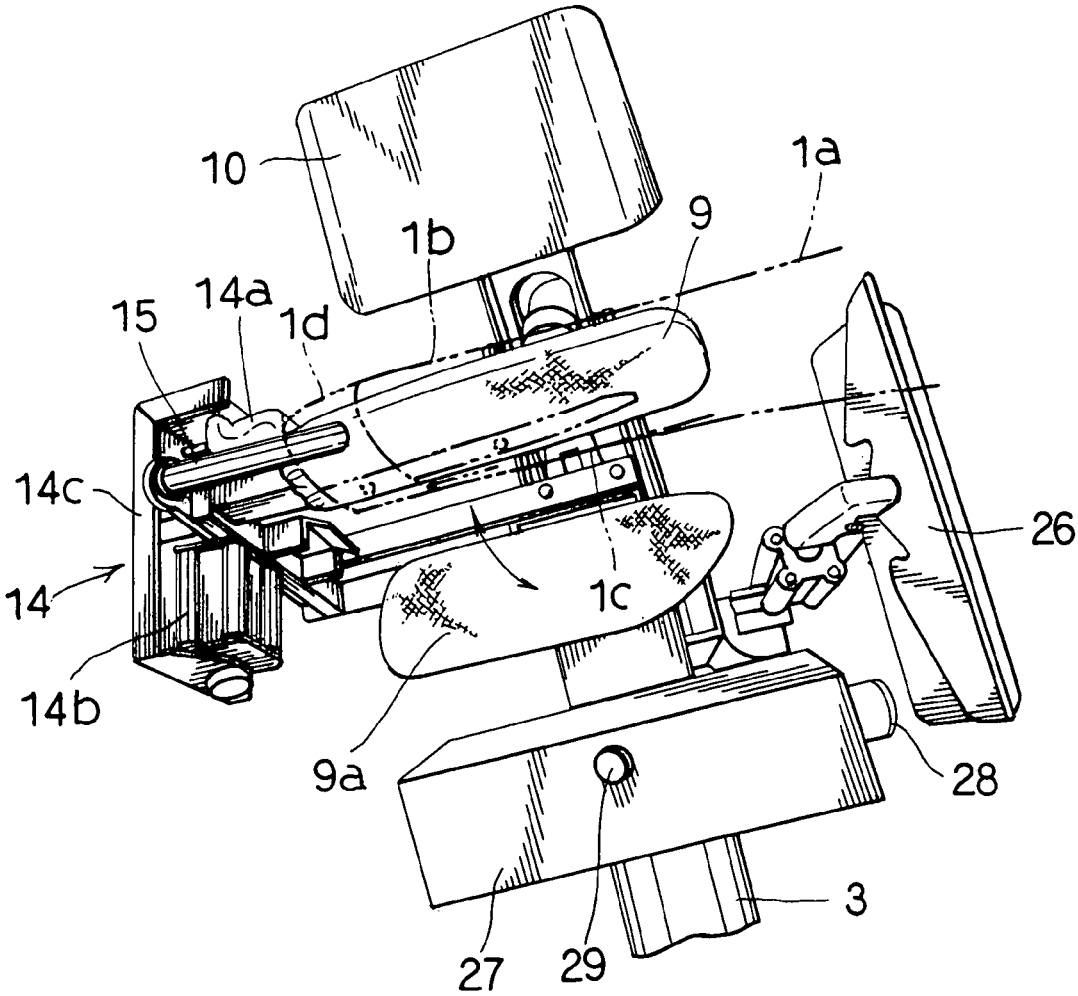
FIG. 3 is a substantial perspective view for showing the shirt finishing machine.

Reference numeral 9 (refer to FIG. 1B and FIG. 3) denotes a lower iron where the extremity end 1*b* of the sleeve 1*a* is set. The lower iron 9 in the preferred embodiment is formed such that its width in a forward or rearward direction as seen from above is narrow and long in a rightward or leftward direction as shown in FIG. 1B. Then, the present invention is formed such that the part 1*c* arranged at the rear side of the lower iron 9 where the extremity end 1*b* of the sleeve 1*a* inserted into the lower iron 9 is extruded out at the rear side of the lower iron 9 is provided with a movable iron 9*a* supported when the upper iron 10 performs a pressing operation. As shown in FIG. 2, the upper surface of the movable iron 9*a* in this preferred embodiment comprises a supporting surface 9*a*1 in flush with the upper surface of the lower iron 9 when the upper iron 10 performs a pressing operation and an inclined surface 9*a*2 communicated with the supporting surface 9*a*1 and having a forward downward inclination. A rear side 91 at the lower surface of the lower iron 9 is formed as an inclined surface of upward inclination in a rearward direction so as to be connected to the inclination surface 9*a*2. The extremity end 1*b* of the sleeve 1*a* is held by the inclination surface 9*a*2 and the rear side 91 at the lower surface of the lower iron 9. Then, the portion 1*c* extruded at the rear side of the lower iron 9 is supported by the movable iron 9*a* and pressed with the upper iron 10.

Figure 6:
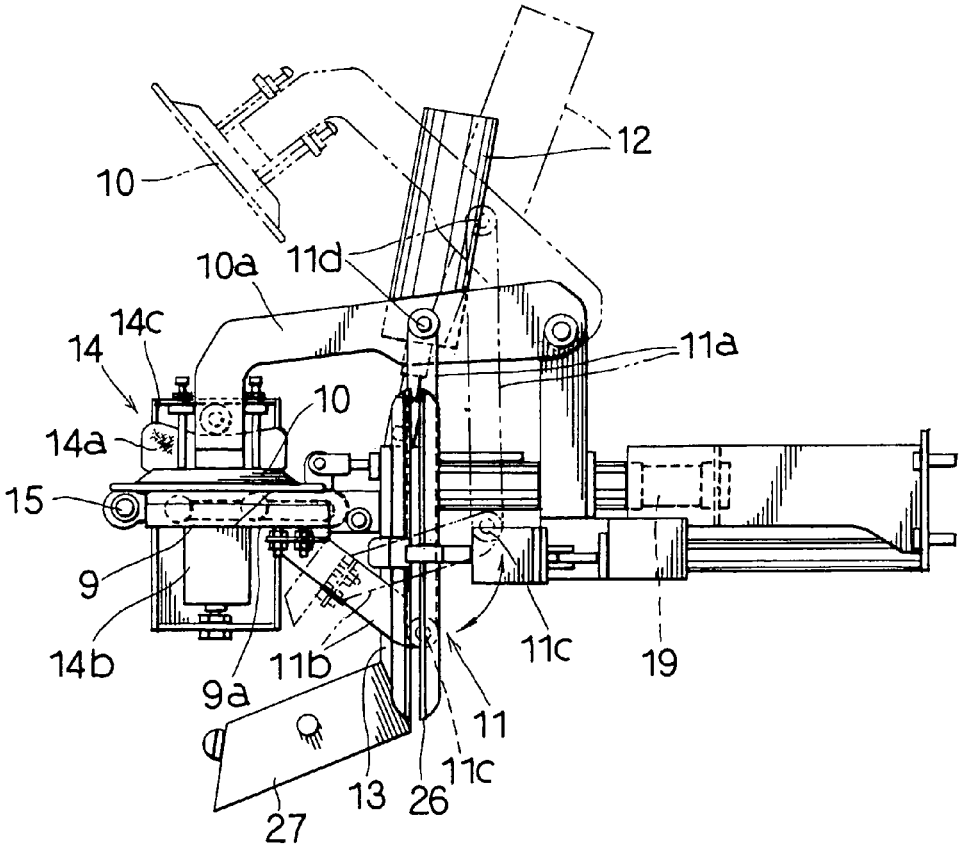
FIG. 6 is a substantial right side elevational view of FIG. 5.

As shown in FIG. 3, the movable iron 9*a* in this preferred embodiment is turned between the rear side of the lower iron 9 and the lower rear position of the lower iron 9 and formed to be freely ascended or descended. The movable iron 9*a* in this preferred embodiment is constructed such that when the upper iron 10 is turned in a forward or rearward direction, it is ascended or descended in cooperation with the turning operation. That is, as shown in FIG. 6, the movable iron 9*a* is connected to the supporting member 10*a* of the upper iron 10 through a link 11 for ascending the movable iron 9*a* and arranging it at the rear side of the lower iron 9 when the upper iron 10 is turned forward and descends and for descending the movable iron 9*a* and retracting it to the lower rear position of the lower iron 9 when the upper iron 10 is turned rearward and ascends. Reference numeral 12 denotes an air cylinder for the upper iron to turn the upper iron 10 in a forward or rearward direction. The main body of the air cylinder 12 for the upper iron is pivoted to the supporting member 10*a*. In addition, the lower end of the rod is pivoted to the frame 13 arranged at the upper part of the supporting arm 3.

Figure 5:
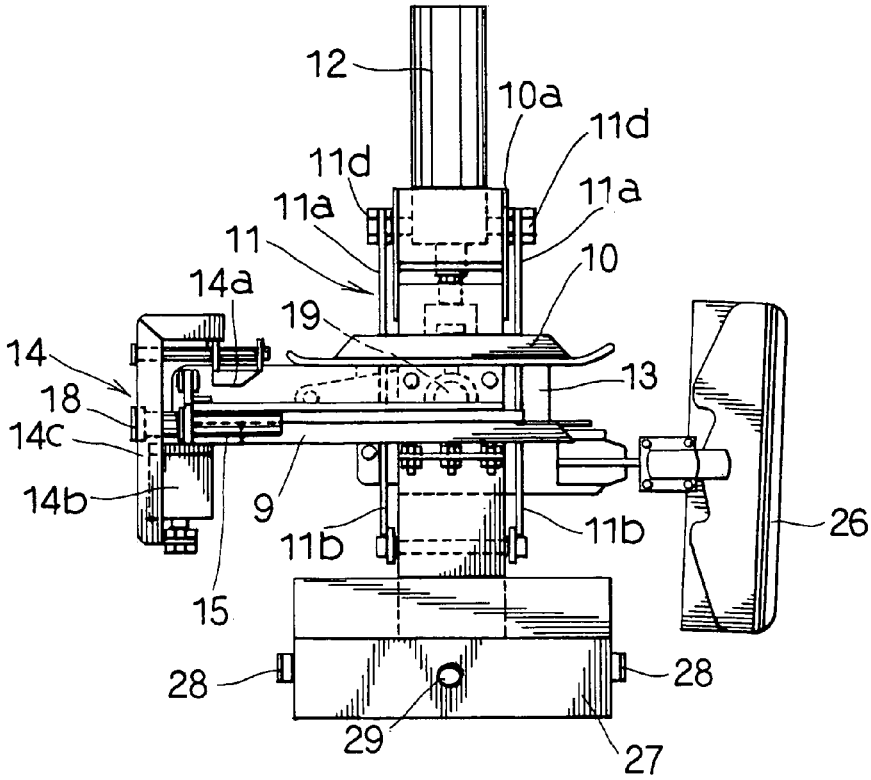
FIG. 5 is a substantial front elevational view for showing the shirt finishing machine.

The aforesaid link 11 comprises an upper cooperating member 11*a* and a lower cooperating member 11*b* and both of them are pivoted by a shaft pin 11*c*. As shown in FIG. 5, the upper cooperating member 11*a* and the lower cooperating member 11*b* are formed in parallel to each other and a pair of right and left forms as seen from its front elevational view. Then, the upper end of the upper cooperating member 11*a* is pivoted to the supporting member 10*a* with the shaft pin 11*d*. The movable iron 9*a* is fixed to the front end of the lower cooperating member 11*b* in a predetermined angle. In addition, when the movable iron 9*a* is arranged at the rear side of the lower iron 9, it is connected to the upper cooperating member 11*a* in such a way that the lower edge extending along a longitudinal direction of the lower cooperating member 11*b* abuts against the predetermined position of the frame 13 to be supporting point. Since the link 11 is constituted as described above, at first when the rod in the air cylinder 12 for the upper iron is retracted and the lower iron 10 descends, the lower cooperating member 11*b* descends together with the upper cooperating member 11*a*. Then, when the lower edge of the lower cooperating member 11*b* extending in its longitudinal direction abuts against the frame 13, the lower cooperating member 11*b* is bent upward around the shaft pin 11*c*. With such an arrangement as above, the movable iron 9*a* is arranged at the rear side of the lower iron 9.

Reference numeral 14 denotes a fixing instrument for use in fixing a cuff 1*d* of the sleeve 1*a* to the lower iron 9. This fixing instrument 14 comprises a pressing part 14*a* arranged above a root portion near outside of the lower iron 9 and an air cylinder 14*b* for the pressing part ascending or descending the pressing part 14*a*. The air cylinder 14*b* for the pressing part is fixed to the frame 13 with its rod being faced downward. The lower end of the rod and the pressing part 14*a* are connected by a hook-shaped connecting member 14*c*, and when the rod is extended downward, the pressing part 14*a* descends together with the connecting member 14*c* and then the cuff 1*d* is pressed against the root part of the lower iron 9 and fixed there. The lower iron 9, upper iron 10 and fixing instrument 14 are fixed to the frame 13 and arranged at the upper part of the supporting arm 3.

Figure 7:
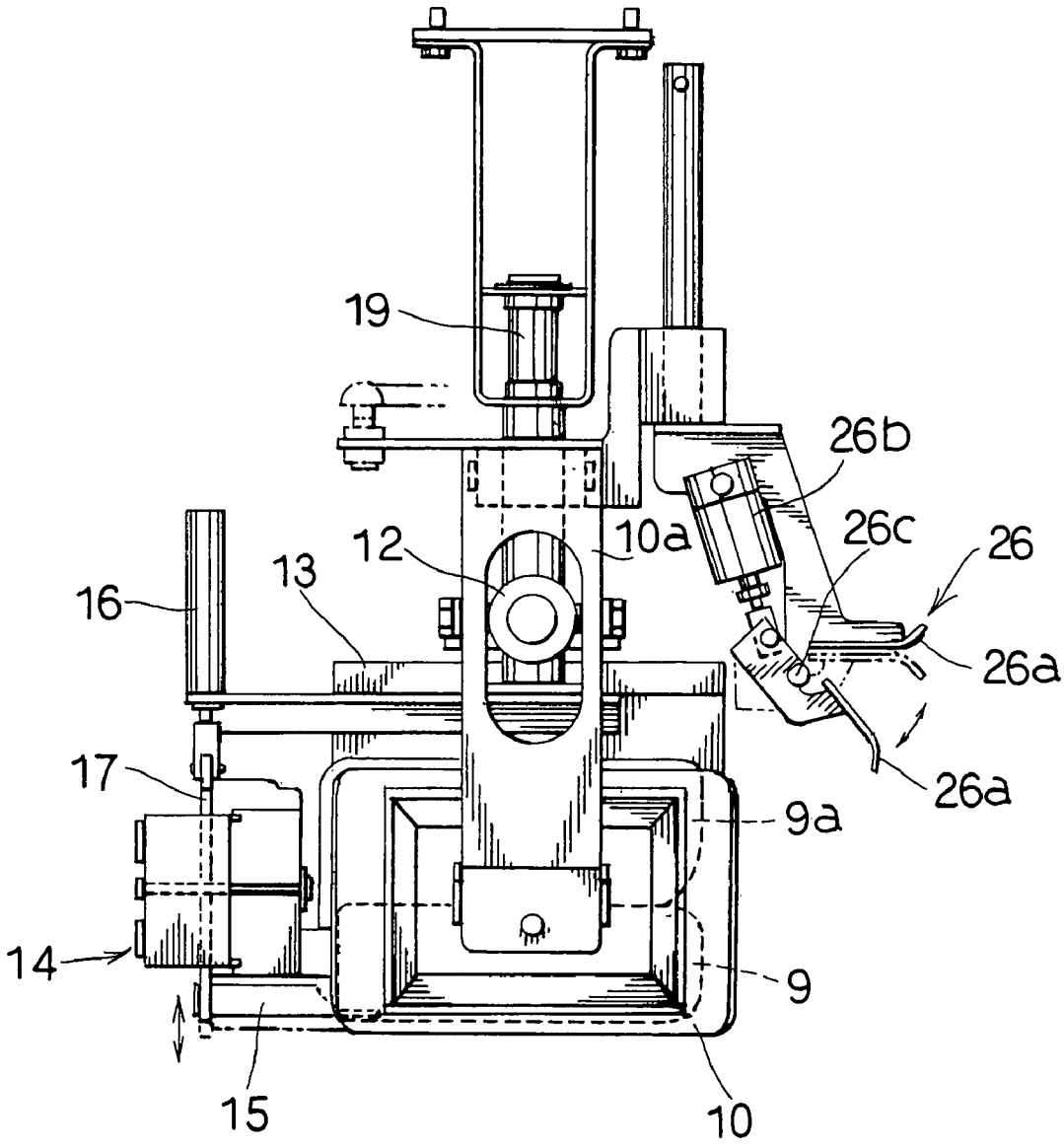
FIG. 7 is a substantial top plan view of FIG. 5.
Figure 8:
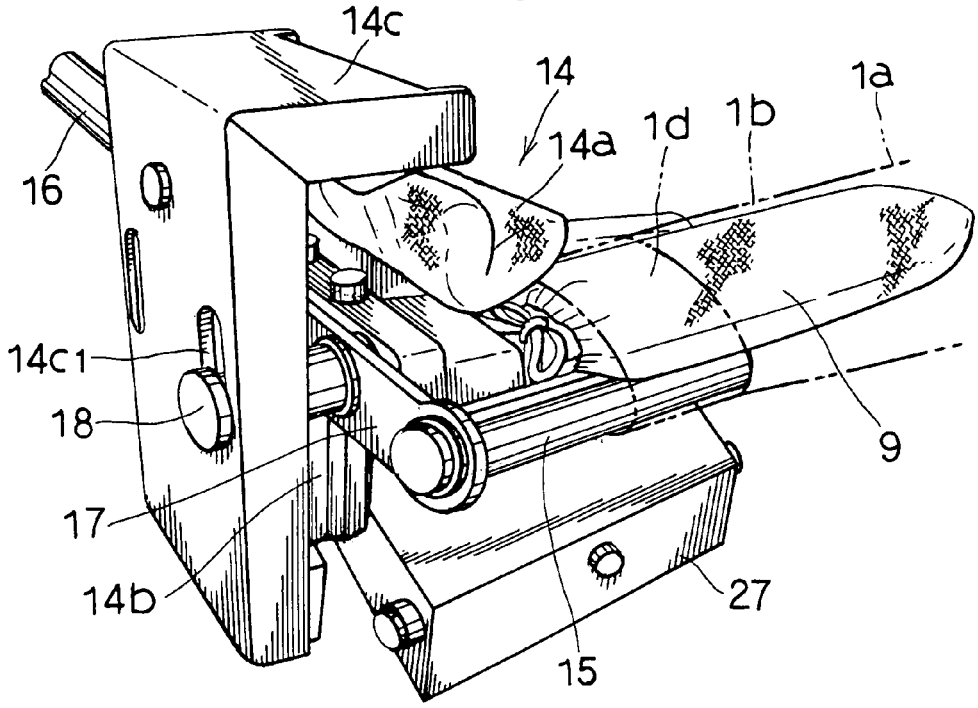
FIG. 8 is a substantial perspective view for showing the upper part of the left side supporting arm as seen from a front side of the shirt finishing machine.

Reference numeral 15 (refer to FIGS. 3, 7 and 8 etc.) denotes a tension member tensioned forward as seen from above the cuff 1*d* fixed to the lower iron 9 with the fixing instrument 14 and tensioning the extremity end 1*b* of the sleeve 1*a* in a forward direction. This tensioning member 15 in this preferred embodiment is arranged at the front side position of the lower iron 9 corresponding to the cuff 1*d* in such a way that it may be moved in a forward or rearward direction.

Figure 9:
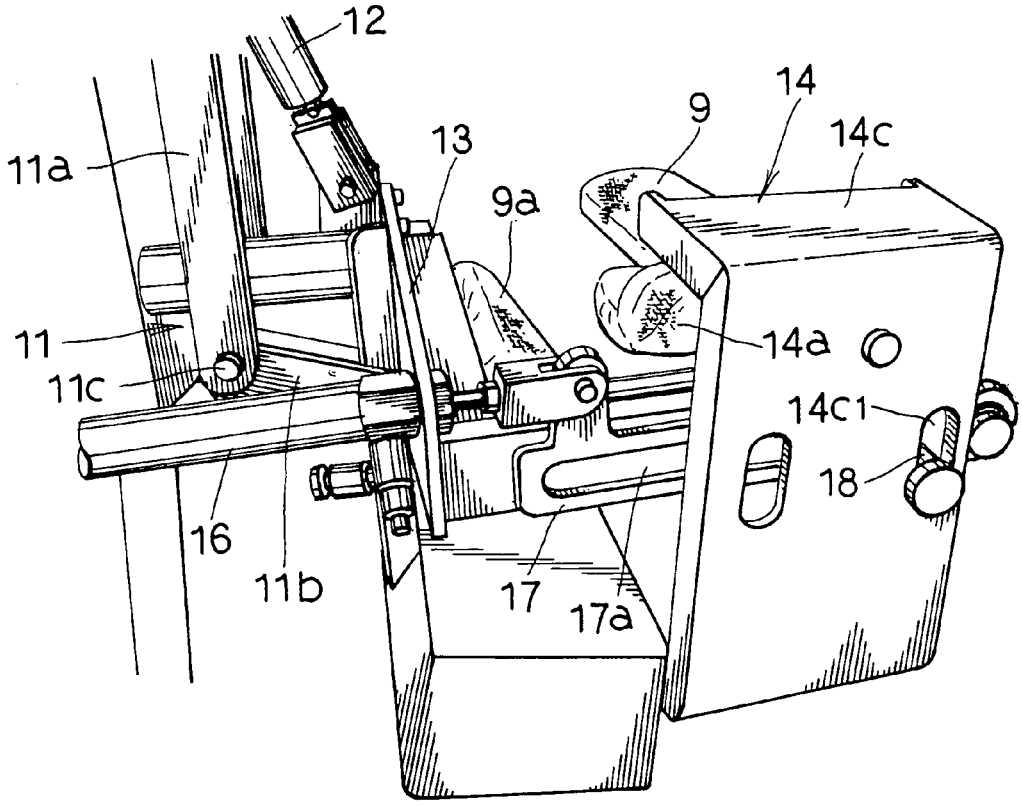
FIG. 9 is a substantial perspective view for showing the upper part of the left side supporting arm as seen from a front side of the shirt finishing machine.

Reference numeral 16 (refer to FIGS. 7 to 9) denotes an air cylinder for a tensioning member for forwarding or retracting the tensioning member 15. This air cylinder 16 for the tensioning member is fixed in a horizontal state at a predetermined position of the frame 13 with the rod being faced forward. This rod has at its extremity end a long plate 17 extending along the longitudinal direction of the rod in an extended form. The long plate 17 is formed with a slit-like hole 17*a* (refer to FIG. 9) engaged with the pin 18 (refer to FIGS. 8 and 9). The pin 18 is formed like a bolt-shape and fixed to a predetermined position of the frame 13 in a lateral facing state. The aforesaid connecting member 14*c* is constructed such that the longitudinal hole 14*c* is engaged with the pin 18, guided by the pin 18 and moved up and down. When the rod in the air cylinder 16 for the tensioning member is extended or retracted, the long plate 17 is guided by the pin 18 and moved in a forward or rearward direction. With such an arrangement as above, the tensioning member 15 moves forward or rearward under its stable attitude and when it moves forward, it tensions the extremity end 1*b* of the sleeve 1*a* in a forward direction and tensions.

Figure 10:
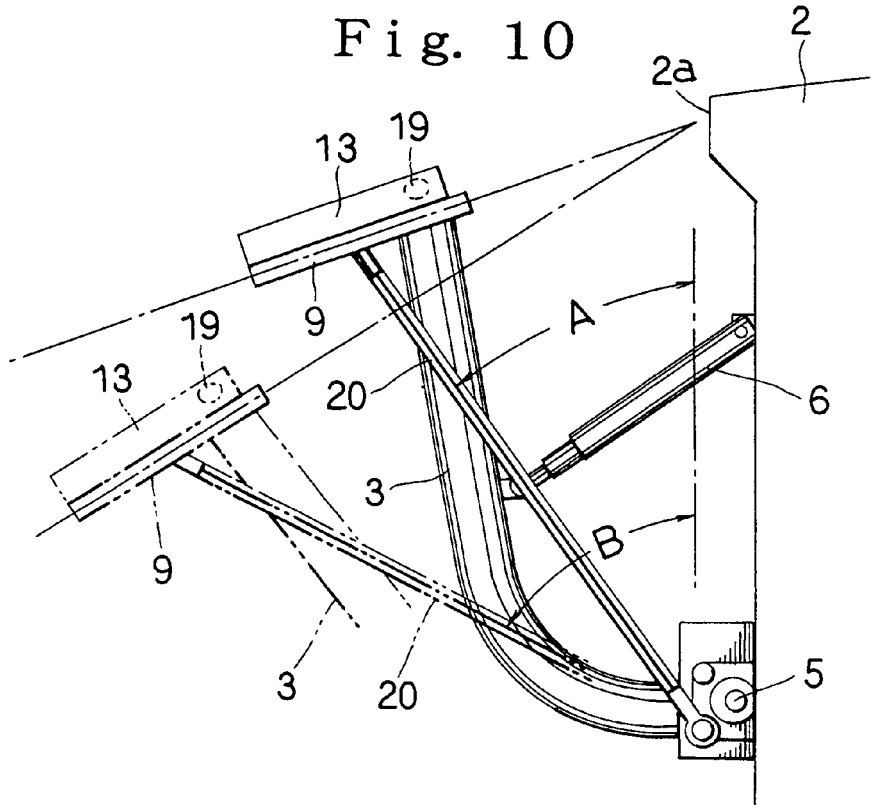
FIG. 10 is a substantial front elevational view for showing a constitution of means for adjusting a truck of the lower iron.
Figure 11:
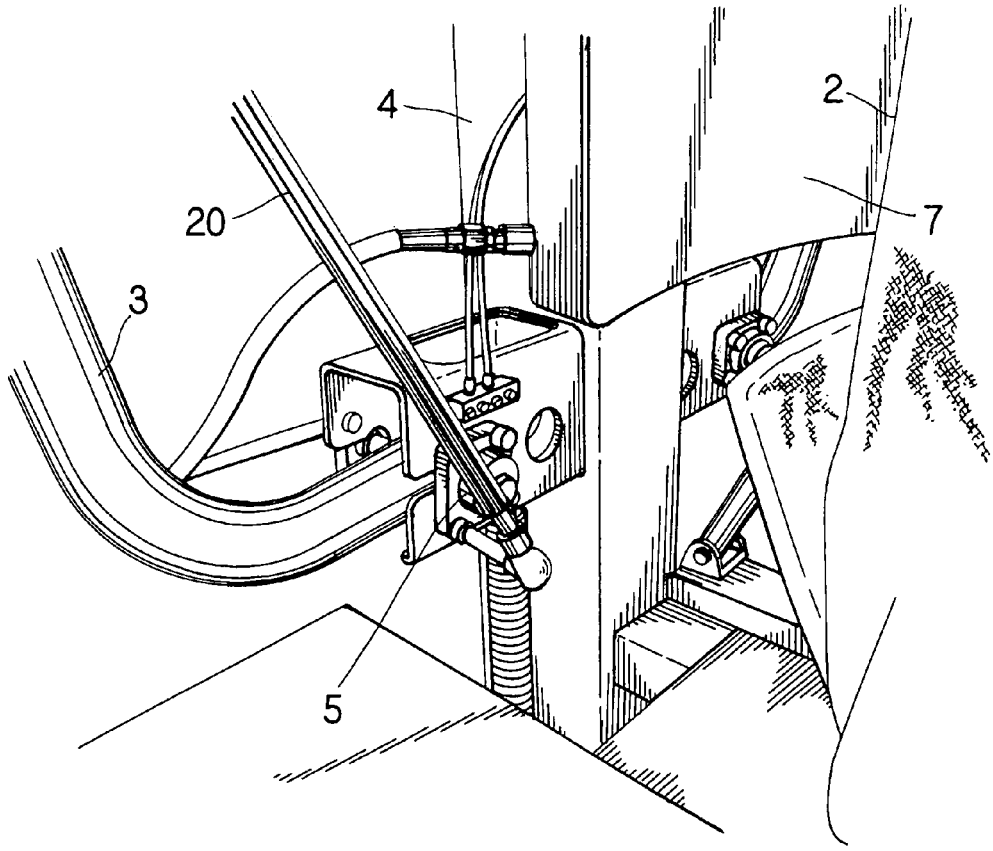
FIG. 11 is a substantial perspective view for showing a shirt finishing machine.

In addition, the aforesaid frame 13 is arranged at the upper part of the supporting arm 3 such that it may be freely turned in a normal direction or reverse direction around the shaft 19 (refer to FIGS. 5 to 7 etc.) extending along the forward or rearward direction. Reference numeral 20 (refer to FIG. 1A, FIG. 10 and FIG. 11) denotes a bar for adjusting a turning angle of the frame 13 as the supporting arm 3 is turned toward a side part and always facing the extremity end of the lower iron 9 toward the shoulder 2*a* of the torso 2. The upper end of this bar is pivoted at a predetermined position of the frame 13 more outside than the shaft 19 and the lower end of this bar is placed near the shaft 5 of the supporting arm 3 and pivoted at a position outside the shaft 5. Then, this bar is arranged at each of the right and left sides of the torso 2, respectively, for every right and left supporting arms 3.

Figure 4:
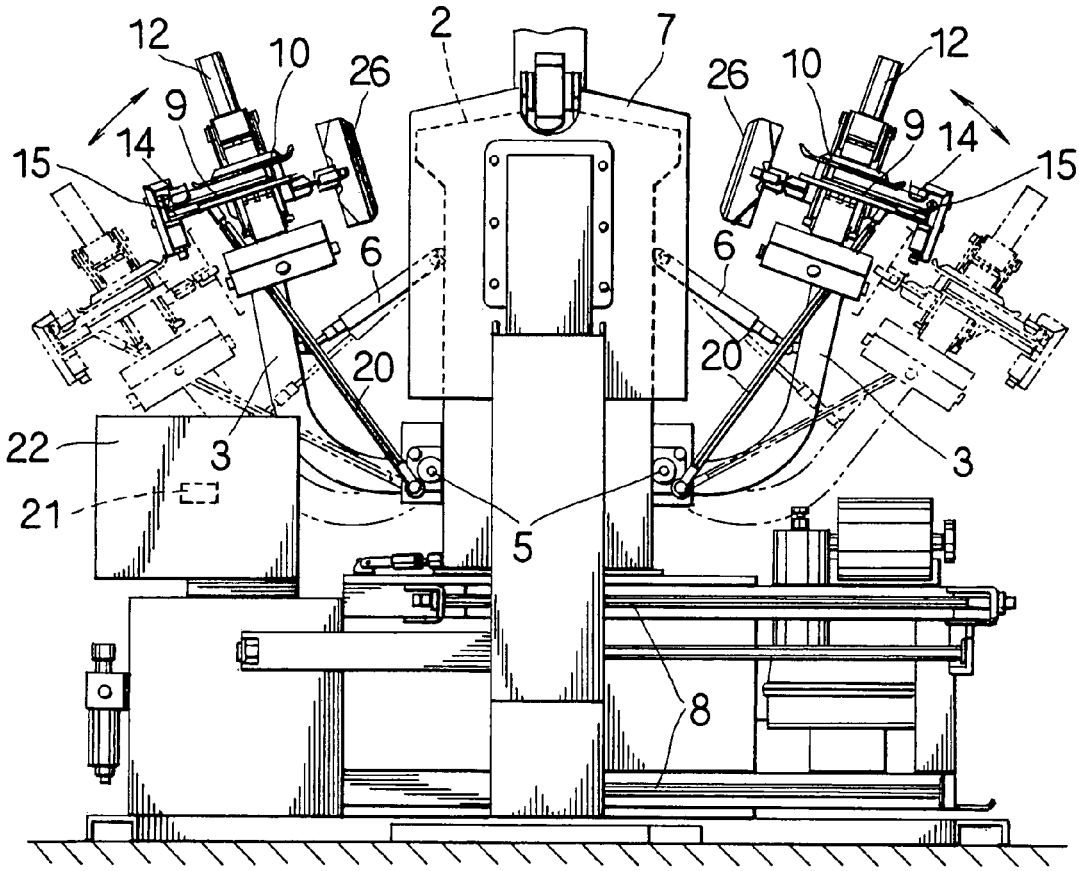
FIG. 4 is a substantial front elevational view for showing the shirt finishing machine.

In addition, the present invention in this preferred embodiment is constituted such that when the supporting arm 3 is inclined to reach the limited state of the pulled state of the sleeve 1*a* of the shirt 1, the air cylinder acting as the driving device 6 is provided with the controller 21 (refer to FIG. 4) for outputting a signal for slightly returning the supporting arm 3 to the side of the torso 2. This controller 21 is constituted by a micro-computer and stored in a control panel 22. Whether or not the sleeve la reaches the limited state of pulling is realized by detecting with a sensor (not shown) a variation in gas pressure in the air cylinder acting as the driving device 6, for example, and comparing this detected value with the limited value of predetermined pulling state. When the detected value reaches up to the limited value, a signal for slightly retracting the rod in the air cylinder is sent from the controller 21 to a solenoid valve in the air circuit for the air cylinder as the driving device 6. With this operation, the supporting arms 3 are slightly returned to the side of the torso 2 and the sleeve 1*a* is tensioned at a state just before the limited state in tension. The shirt finishing machine of the present invention is operated such that both hot air and steam are supplied into the sleeve 1*a* under this state and the sleeve 1*a* is finished in tension.

Figure 12:
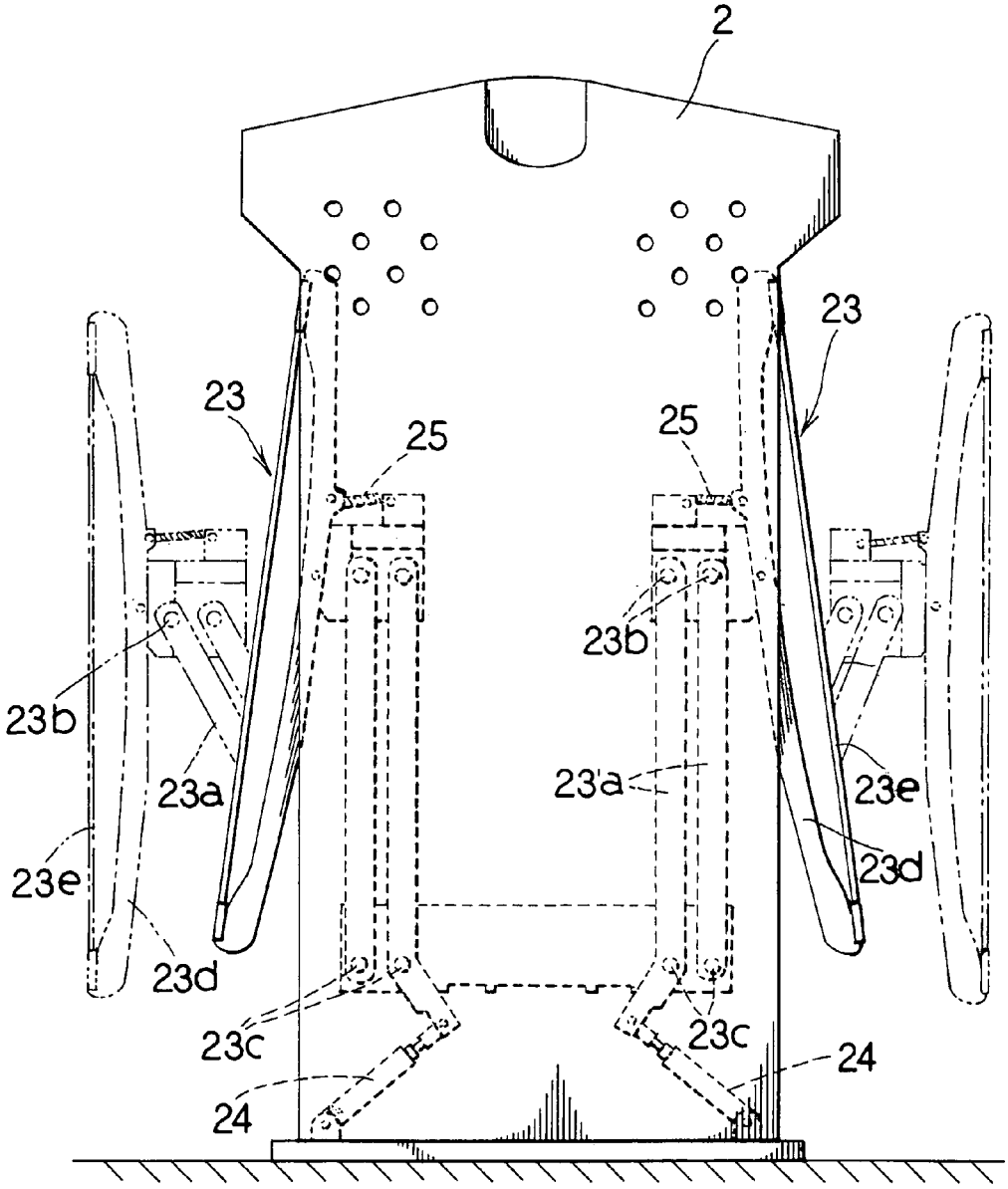
FIG. 12 is a substantial front elevational view for showing a shirt finishing machine.

Reference numeral 23 (refer to FIG. 12) denotes a trunk tension member for tensioning the side of the shirt 1 covered on the torso 2 to the side of the torso 2. The trunk tension members 23 are arranged at both sides of the torso 2 and attached to the upper part of the raised supporting piece 23*a* through the shaft 23*b* along a forward or rearward direction of the torso 2 in such a way that they may be turned by a predetermined angle in an upward or downward direction. Each of a pair of supporting pieces 23*a* is arranged in parallel to each other while the torso 2is seen from the front elevational view. Then, the rod in the air cylinder 24 for the trunk tension member is pivoted at the lower end of the inside supporting piece 23*a*. The air cylinder 24 for the trunk tension member is arranged at the lower part in the torso 2. Accordingly, in the case of the present invention in regard to this preferred embodiment, since the air cylinder 24 is not exposed outside the torso 2, the outer periphery of the lower part of the torso 2 is made clean and then the work for putting the shirt 1 to the torso 2 or putting off the shirt 2 from the torso 2 can be easily carried out without any trouble. Then, the trunk member 23 is constituted such that it is inclined outwardly by its own weight around the pivoted shaft 23*c* along the forward or rearward direction of the torso 2 so as to apply a tension to the side of the shirt 1. That is, when the rod in the air cylinder 24 for the trunk tension member extends to push the lower end of the inner supporting piece 23*a* into the torso 2, the supporting piece 23*a* is inclined outwardly around the pivot shaft 23*c*. The air cylinder 24 for the trunk tension member is constituted such that when the rod is extended up to a position where the trunk tension member 23 is inclined outwardly by its own weight, its driving operation is stopped and afterwards, as the trunk tension member 23 is inclined, the rod is automatically drawn. Resetting of the trunk tension member 23 is performed automatically through retraction of the rod in the air cylinder 24 for the trunk tension member. The trunk tension member 23 in this preferred embodiment is constituted by an arcuate member 23*d* and wire members 23*e* tensioned at the upper and lower ends of the arcuate member 23*d*. The wire members 23*e* are made of flexible metallic material in such a way that they may cooperate with a coil spring 25 for moving the trunk tension member 23 smoothly and they may be fitted along the line of the side of the shirt 1.

Reference numeral 26 (refer to FIGS. 5 and 7) denotes a clamp device used when the shirt 1 is a semi-sleeve shirt. This clamp device 26 is fixed to the aforesaid frame 13 while the pair of holding piece 26*a* (refer to FIG. 7) are set in a vertical orientation. Reference numeral 26*b* denotes a holding piece air cylinder for use in opening or closing the holding pieces 26*a*. When the rod of this holding piece air cylinder 26*b* is extended, one holding piece 26*a* is turned around the vertical shaft 26*c* and closed and in turn when the rod is retracted, the holding piece 26*a* is opened. The present invention in this preferred embodiment is constituted such that both the long sleeve shirt 1 and the semi-sleeve shirt 1 can be finished with one finishing machine by arranging such a clamp device 26 as above. Further, reference numeral 27 (refer to FIG. 1A) denotes a switch box including various types of switches 28 or lamps 29.

Then, the action of the present invention in accordance with the preferred embodiment will be described as follows.

At first, an operator puts on the shirt 1 on the torso 2 and arranges the front and rear bodices of the shirt 1. In this case, the inside portion of the torso 2 is evacuated and the front and rear bodices of the shirt 1 are adsorbed against the torso 2. Under this state, the rod in the air cylinder 24 for the trunk tension member is extended by a preset short distance. Then, the supporting piece 23*a* is turned outwardly around the pivoted shaft 23*c* and inclined from its vertical position in an outward direction. With such an operation as above, the trunk tension member 23 is inclined by its own weight to cause the side of the shirt 1 to be tensioned outwardly and apply a tension to it.

Then, the operator inserts the extremity end 1*b* of the left sleeve 1*a* as seen from the front side of the torso 2 into the lower iron 9 at the left side of the supporting arm 3 arranged near the torso 2. In this case, the operator attaches the inner surface of the extremity end 1*b* of the sleeve 1*a* against the front side surface of the lower iron 9, pulls the extremity end 1*b* toward a rearward of the lower iron 9 and sets it. Under this state, the operator fixes the cuff 1*d* to the root part of the lower iron 9 with the pressing part 14*a* of the fixing instrument 14. Then, the tension member 15 advances forward of the lower iron 9 to push the extremity end 1*b* of the sleeve 1*a* forwardly and apply a tension to it. As shown in FIG. 6, under this state, the upper iron 10 descends. Then, the movable iron 9*a* is turned in a front upward direction under an action of the link 11 and arranged at the rear side of the lower iron 9. With this arrangement above, the movable iron 9*a* supports the part 1*c* (refer to FIG. 1B) of the sleeve 1*a* extruded at the rear side of the lower iron 9. Then, under this state, the upper iron 10 press finishes the extremity end 1*b*.

The shirt finishing machine of the present invention in accordance with this preferred embodiment presses the extremity end 1*b* of the left sleeve 1*a* in this way, then both shoulders of the shirt 1 are pressed with a shoulder press machine (not shown). Then, a pair of press irons 7 are arranged to be oppositely faced against the torso 2 so as to press both front bodice and rear bodice of the shirt 1.

Then, the operator inserts the right sleeve 1*a* as seen from the front side of the torso 2 into the right lower iron 9 and fixes the extremity end 1*b* with the fixing instrument 14. Then, the operator applies a tension to the extremity end 1*b* with the tension member 15. After this operation, the upper iron 10 descends in the same manner as that of the aforesaid example, the movable iron 9*a* is arranged at the rear side of the lower iron 9 so as to support the part 1*c* of the sleeve 1*a* expelled at the rear side of the lower iron 9. Then, under this state, the upper iron 10 press finishes the extremity end 1*b* of the right sleeve 1*a*.

Then, the rod in the air cylinder acting as the driving device 6 extends and the supporting arm 3 inclines. Then, when the sleeve 1*a* reaches up to the limit of the pulled state, the rod in the air cylinder is slightly retracted with a signal got from the controller 21. With such an arrangement as above, the supporting arm 3 is slightly pulled back to the torso 2. Then, under this state, both steam and hot air are supplied into the sleeve 1*a* at the inner side of the torso 2 through the shoulder 2*a*, the sleeve 1*a* is expanded and finished in tension.

Thus, in case of the present invention, when the supporting arm 3 is inclined or raised up, the extremity end of the lower iron 9 is always faced toward the shoulder 2*a* of the torso 2 under an action of the bar acting as means 20 for adjusting a locus of the lower iron 9. That is, in FIG. 10, when the supporting arm 3 is inclined from a position of angle A to a position of angle B, the frame 13 is gradually turned in a clockwise direction around the shaft 19 to a state where the extremity end of the lower iron 9 faces against the shoulder 2*a* of the torso 2 as the supporting arm 3 is inclined because a length of the bar is kept constant. In addition, when the supporting arm 3 is raised up, the frame 13 is turned in a counter-clockwise direction and the extremity end of the lower iron 9 is always faced against the shoulder 2*a* of the torso 2. Accordingly, in case of the present invention, there occurs no possibility that the sleeve 1*a* is contacted with the extremity end of the lower iron 9 or pushed by the extremity end of the lower iron 9 when the supporting arm 3 is turned.

With the foregoing arrangement, although the width of the lower iron 9 in its forward and rearward direction is formed narrow in the above example and the movable iron 9*a* is arranged at the rear side of the lower iron 9, the present invention is not limited to this arrangement. That is, it may also be applicable in the present invention that a width of the lower iron in its forward and rearward direction is formed wide in the same manner as that of the prior art machine and the movable iron 9*a* is formed in a substantial same size as that of the lower surface of the lower iron 9 so as to press the entire lower surface of the extremity end 1*b* of the sleeve 1*a*. Further, in case of the present invention, the aforesaid fixing instrument 14 may also be applicable as a holding type for holding the cuff 1*d* from above and below and fixing it.

In addition, the aforesaid movable iron 9*a* may also be applicable that it is descended directly from the rear side position of the lower iron 9 or slid just after the lower iron 9 and retracted. Although the movable iron 9*a* in the aforesaid example is formed to be cooperated with the upper iron 10 through the link 11, it may also be controlled by an operating means separate from the upper iron 10. Further, it may also be applicable that the movable iron 9*a* is supplied with steam, for example, in its inside part and it can be heated with steam.

What is claimed is:

1. A shirt finishing machine comprising a torso for putting on a shirt and a pair of right and left supporting arms arranged at both sides of the torso, inclined toward the sides of the torso to pull the sleeves of the shirt, wherein the upper portion of the supporting arm is provided with a lower iron to which the extremity end of the sleeve is set, a fixing instrument for use in fixing a cuff of the sleeve to the lower iron, an upper iron for pressing against the upper surface of the lower iron to press finish the extremity end of the sleeve, and there is provided a movable iron for pressing the lower surface of the extremity end of the sleeve inserted into said lower iron at the time of pressing with the upper iron, wherein a width of the lower iron in a forward and rearward direction as seen from above is formed narrow, the movable iron is arranged at the rear side of the lower iron at the time of pressing of the upper iron, and a part where the extremity end of the sleeve is expelled at the rear side of the lower iron is formed to be supported by the movable iron, wherein the cuff fixed to the lower iron with a fixing instrument is expelled to the front side as seen from above and there is provided a tension member for applying tension to the extremity end of the sleeve in a forward direction, and wherein the movable iron is turned between the rear side of the lower iron and the lower rear position of the lower iron and arranged in such a way that it can be ascended or descended.

2. The shirt finishing machine according to claim 1, wherein the supporting member for the upper iron and the movable iron are connected through a link for use in ascending the movable iron when the upper iron is turned forwardly and descends and arranging the movable iron at the rear side of the lower iron and for use in descending the movable iron when the upper iron is turned rearwardly and ascends and retracting the movable iron at a lower rear position of the lower iron.

3. The shirt finishing machine according to claim 1, wherein the lower iron, fixing instrument and upper iron are fixed to the frame, arranged at the upper part of the supporting arm, the frame is formed to be turnable around the shaft extending along a forward and rearward direction of the torso in a normal or reverse direction and there is provided means for adjusting a turning angle of the frame to such a state where the extremity end of the lower iron is always faces against a shoulder of the torso as the supporting arm is turned.

4. The shirt finishing machine according to claim 2, wherein the lower iron, fixing instrument and upper iron are fixed to the frame, arranged at the upper part of the supporting arm, the frame is formed to be turnable around the shaft extending along a forward and rearward direction of the torso in a normal or reverse direction and there is provided means for adjusting a turning angle of the frame to such a state where the extremity end of the lower iron is always faced against the shoulder of the torso as a supporting arm is turned.

5. The shirt finishing machine according to claim 1, wherein there is provided a controller for outputting a signal for slightly returning the supporting arm to the side of the torso to a driving device for the supporting arm as the supporting arm is inclined and reaches up to a limit of pulling state of the sleeve of the shirt.

6. The shirt finishing machine according to claim 4, wherein there is provided a controller for outputting a signal for slightly returning the supporting arm to the side of the torso to a driving device for the supporting arm as the supporting arm is inclined and reaches up to a limit of pulling state of the sleeve of the shirt.

7. The shirt finishing machine according to claim 1, wherein both sides of the torso are provided with a trunk tension member inclined by its own weight to the side of the torso to expel the side of the shirt covered on the torso and apply tension to it.

8. The shirt finishing machine according to claim 6, wherein both sides of the torso are provided with a trunk tension member inclined by its own weight to the side of the torso to expel the side of the shirt covered on the torso and apply tension to it.

* * * * *